US005606218A

United States Patent [19]

Cotter et al.

[11] Patent Number: 5,606,218

[45] Date of Patent: Feb. 25, 1997

[54] COLD CATHODE SUBMINIATURE FLUORESCENT LAMP

[75] Inventors: Daniel J. Cotter, Easton; Robert Y. Pai, Hamilton, both of Mass.

[73] Assignee: Osram Sylvania Inc., Danvers, Mass.

[21] Appl. No.: 410,440

[22] Filed: Mar. 24, 1995

[51] Int. Cl.[6] ..... H01J 61/067

[52] U.S. Cl. ..... 313/485; 313/491; 313/574; 313/575; 313/576; 313/631; 313/632

[58] Field of Search ..... 313/485, 491, 313/492, 493, 574, 575, 576, 614, 623, 631, 632

[56] References Cited

U.S. PATENT DOCUMENTS

| | | | |
|---|---|---|---|
| 2,003,493 | 6/1935 | Rentschler et al. . | |
| 2,030,435 | 2/1936 | Fehse et al. . | |
| 2,087,735 | 7/1937 | Pirani et al. . | |
| 4,935,664 | 6/1990 | Whitney | 313/491 |
| 5,210,461 | 5/1993 | Pai et al. | 313/491 |
| 5,256,935 | 10/1993 | Dobashi et al. | 313/491 |

*Primary Examiner*—Nimeshkumar Patel
*Attorney, Agent, or Firm*—Carlo S. Bessone

[57] ABSTRACT

There is presented a cold cathode subminiature fluorescent lamp comprising a glass envelope, a pair of lead wires sealed to the envelope and extending through the envelope at an entry location to the interior thereof, an electrode mounted on the lead wires in the envelope, and a ceramic-glass bead formed on and around the lead wires in the envelope between the electrode and the entry location. The electrode includes a plurality of metal wire tabs. The envelope contains a fill gas comprising neon and argon.

19 Claims, 3 Drawing Sheets

| GEOMETRY | SURFACE AREA ($mm^2$) | CURRENT AT ROOTING INITIATION (mA-RMS) |
|---|---|---|
| STANDARD COLD CATHODE 2-TAB ELECTRODE NO BEAD | 88 | 6 |
| 2-TAB WITH BEAD | 88 | 16-18 |
| 3-TAB NO BEAD | 132 | 10 |
| 3-TAB WITH BEAD | 132 | GREATER THAN 20 |

FIG. 5

COLD CATHODE SUBMINIATURE FLUORESCENT LAMP

BACKGROUND OF THE INVENTION

1. Field of the Invention

The invention relates to fluorescent lamps, and is directed more particularly to a cold cathode subminiature fluorescent lamp with an electrode configuration enabling operation at high current densities and concomitant high illuminance levels.

2. Description of the Prior Art

Subminiature fluorescent lamps, i.e., those having a diameter of 7 mm or less, with high lumen per watt efficiency, are employed where low power consumption and/or low thermal loading is essential. In many instances, such small diameter lamps replace several incandescent bulbs, and high surface brightness and total luminance levels are required.

Brightness in such low-pressure discharge lamps is directly proportional to lamp current applied. However, high currents, in conjunction with the small diameters of the lamps and the compact electrodes employed, often result in excessive current densities at the cathode. Early failures of subminiature lamps operated at high current densities have been observed and causally linked to the tendency of the discharge to dwell, or "root", on the lead wires used to supply electrical power to the electrodes.

Referring to FIGS. 1 and 2, at low lamp currents, the discharge concentrates on portions of the cold cathode lamp electrode 10, and the affected area glows. As the current in the lamp is increased, the discharge envelops the available surface area of the electrode 10 and moves down the lead wires 12, 14. The discharge roots on the lead wires 12, 14, a phenomenon which is readily viewable as a bright glow on the electrode and lead wires. The lamp envelope 16 typically is a soda lime glass and, when the lead wires 12, 14 are enveloped by the discharge, a reaction occurs at the lead wire to glass envelope interface 18 which yields free sodium. In due course, the glass to lead wire seal at the interface 18 is compromised by the reaction and the lamp vents to the atmosphere and fails. Such a failure often occurs in as little as 100 hours of operation in lamps having a rated life of 10,000 hours.

Accordingly, there exists a need for a cold cathode subminiature fluorescent lamp which is not subject to premature failure caused by discharge rooting on the lead wires and consequent depletion and failure of the lead wire to glass envelope seal.

SUMMARY OF THE INVENTION

It is, therefore, an object of the invention to provide a cold cathode subminiature fluorescent lamp having an electrode configuration militating against discharge rooting on lead wires.

A further object of the invention is to provide a cold cathode subminiature fluorescent lamp having in conjunction with the improved electrode configuration a fill gas which contributes further to the advantages of the invention.

With the above and other objects in view, as will hereinafter appear, a feature of the invention is the provision of a cold cathode subminiature fluorescent lamp comprising a glass envelope, a pair of lead wires extending from outside the envelope, through the envelope and into the envelope, the lead wires being sealed to the envelope, an electrode mounted on the lead wires in the envelope, and a ceramic-glass bead formed on and around the lead wires in the envelope between the electrode and the entry location.

In accordance with a further feature of the invention, there is provided a lamp as described immediately above, and provided with an electrode having a plurality of tabs, each of the tabs comprising a metal wire forming a polygon. One side of each of the tabs is joined with a corresponding side of the other of the tabs to form an electrode base portion which is fixed to ends of the lead wires.

In accordance with a still further feature of the invention, there is provided a lamp as described immediately above, wherein the lamp is provided with a fill gas retained by the envelope, and the fill gas is 90 Torr Penning mix, comprising about 99.5% Neon and about 0.5% Argon, by weight.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of the invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings:

FIG. 5 is a chart showing the advantage of providing the ceramic-glass bead component to the electrode and, further, the additional advantage of providing in combination with the bead an electrode of increased surface area.

DESCRIPTION OF THE PREFERRED EMBODIMENT

Figure 1:
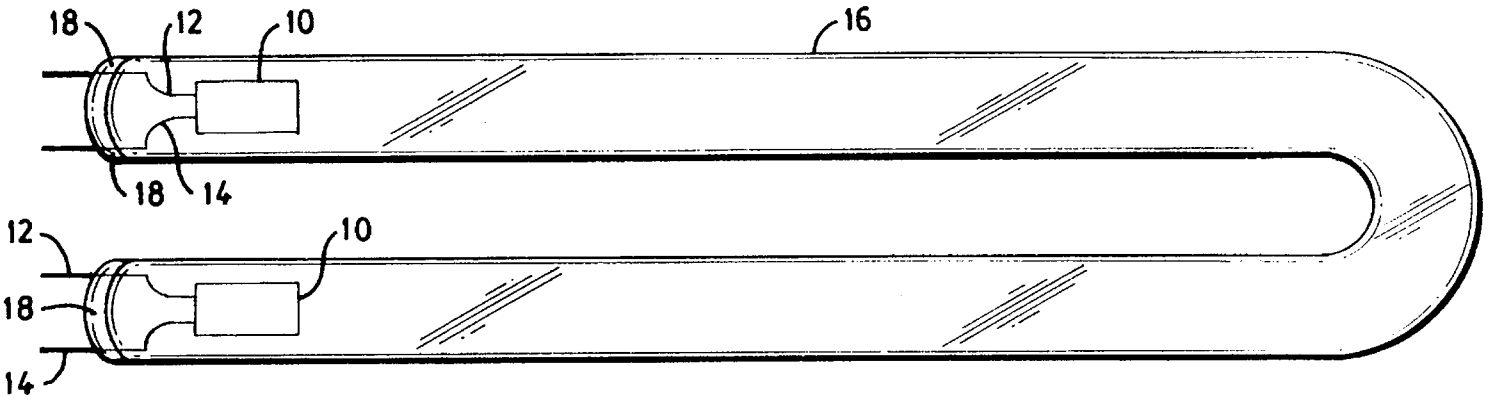
PRIOR ART FIG. 1
FIG. 1 is a plan view of a prior art cold cathode subminiature fluorescent lamp.
Figure 2:
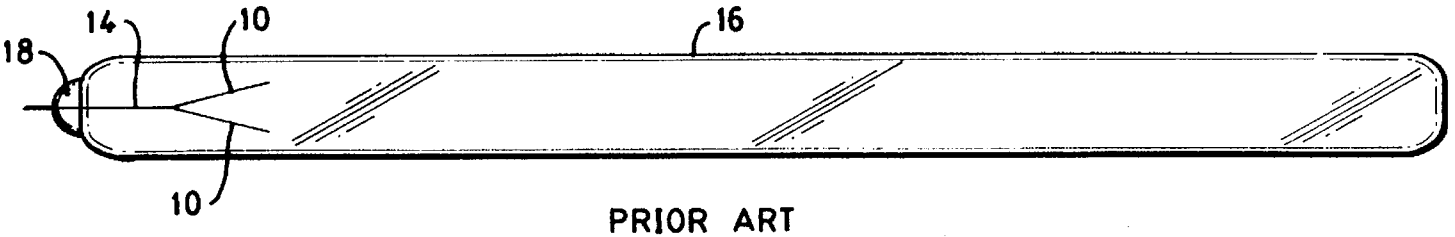
PRIOR ART FIG. 2
FIG. 2 is a side elevational view of the lamp of FIG. 1.
Figure 3:
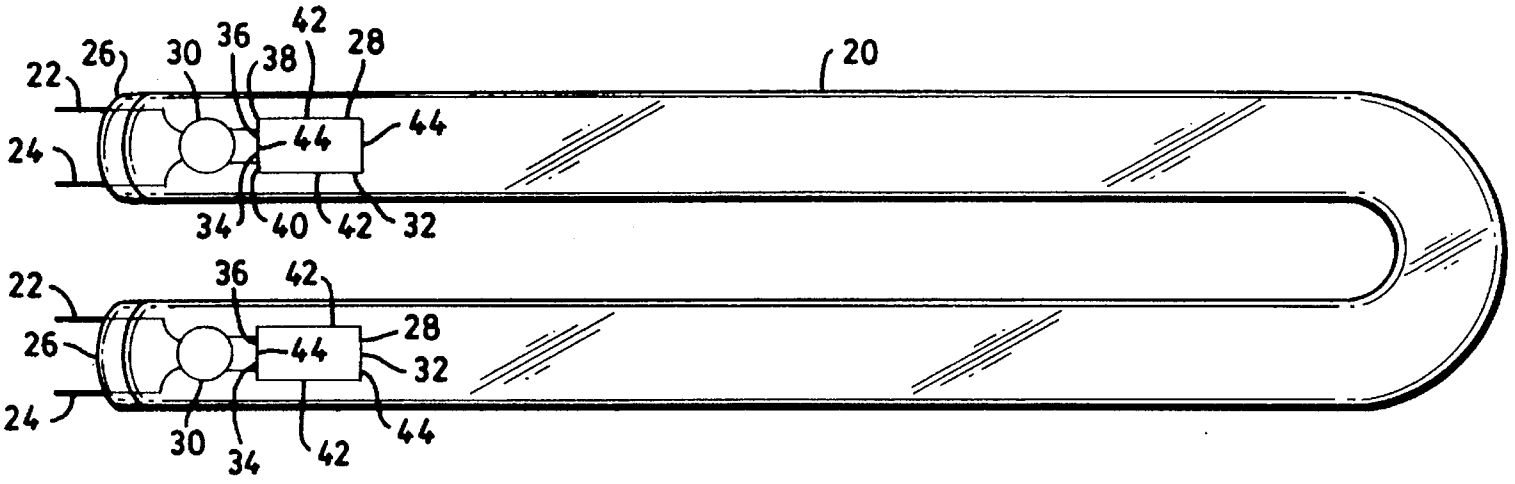
FIG. 3 is a plan view of one form of cold cathode subminiature fluorescent lamp illustrative of an embodiment of the invention.
Figure 4:
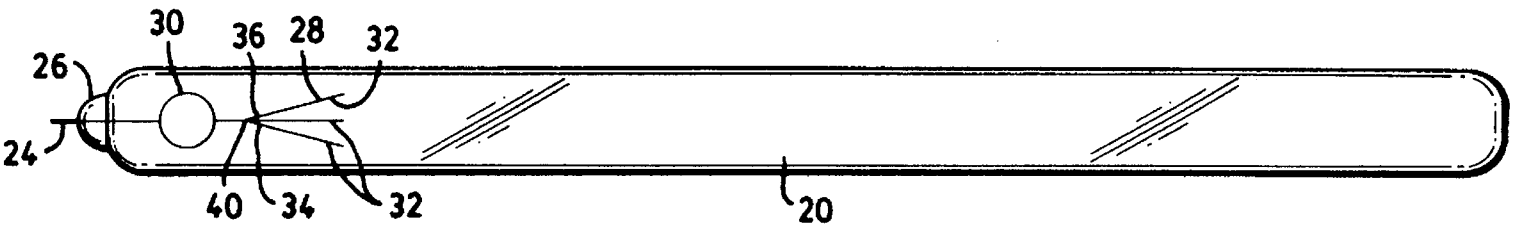
FIG. 4 is a side elevational view of the lamp of FIG. 3.

Referring to FIGS. 3 and 4, it will be seen that an illustrative embodiment of the invention includes a glass envelope 20, having a diameter of 7 mm or less. A pair of lead wires 22, 24 extend from outside the envelope 20, through the envelope at an entry location 26, and into the envelope. At the envelope-lead wire interface, at the entry location 26, the lead wires 22, 24 are sealed to the glass envelope 20. An electrode 28 is mounted on the lead wires 22, 24 within the envelope 20. The arrangement described thus far is in accordance with the teachings of the prior art, as shown in FIGS. 1 and 2.

In accordance with the invention, a ceramic-glass insulating bead 30 is provided on and around the lead wires 22, 24, as shown in FIGS. 3 and 4. The bead 30 is applied to the wires 22, 24 in liquid form and allowed to solidify. The bead 30 is fabricated from a tenaciously bonded sintered material, such as barium oxide, and is substantially lead free. The ceramic-glass bead 30 employed has a higher melting point and higher softening point than conventional glass beads, typically made from leaded soft glass (including as much as 68% lead) containing sodium and/or other such impurities. While prior art glass beads typically are used for purposes of structural integrity and form no part of the electrical circuiting of the lamp, the bead herein disclosed is employed as an enabling electrical component for high current density cold cathode lamps. The insulating bead 30 provides a break in the contiguous path of electrons supplied to the electrode 28.

In accordance with the invention, the electrode 28 comprises a plurality of tabs 32, each of the tabs comprising a metal wire forming a polygon, with one side 34 of each of the tabs 32 being joined with corresponding sides of the other of the tabs 32 to form an electrode base portion 36 which is fixed to ends 38, 40 of the lead wires 22, 24. The tab metal wire preferably is of a nickel-based metal.

As illustrated in FIGS. 3 and 4, the tabs 32 preferably are formed in the shape of a rectangle. In a preferred embodiment, the long sides 42 are about 6.5 mm in length, the short sides 44 are about 3.4 mm in length, and the wire is provided with a diameter of about 0.25 mm. Each of the tabs 32 presents a surface area of about 44 $mm^2$. It has been found advantageous to provide three tabs 32 which, together, present a surface area of 132 $mm^2$.

The above-described combination of ceramic-glass bead 30 and three-tab electrode 28, when used in conjunction with an ill-chosen fill gas, can lead to sputtering when operated at 20 mA, wherein metal atoms from the electrode 28 are returned to the electrode before they can deposit on the fluorescent coating or glass wall of the envelope 20. Over time, sputtering can coat the insulating bead 30, providing a contiguous path to the lead wire to glass interface at the entry location 26.

An appropriate fill gas has been found in 90 Torr Penning mix(99.5% Neon; 0.5% Argon). In lamps having the bead 30 and the electrode 28, as described hereinabove, the use of 90 Torr Penning mix fill gas has been found devoid of severe sputtering. Other fill gases may be suitable for various operating conditions. Fill gas composition and pressure are dictated in part by the lamp starting characteristics and ballast design. To realize optimum performance of the lamp herein described, it is necessary to create the propensity for the discharge to remain rooted on the electrode and not migrate to the lead wires, that the electrode be provided with sufficient surface area, and that a fill gas be provided which limits sputtering at the electrical operating parameters selected.

Referring to FIG. 5, which depicts test results of four lamps, all of which contained the 90 Torr Penning mix, it will be seen that in a standard cold cathode 2-tab electrode with no bead, rooting was initiated at the lead wire-glass interface at a current of 6 mA. By adding the bead 30, the 2-tab electrode started rooting at 16–18 mA. By adding a third tab, with no bead, the electrode started rooting at 10 mA. Thus, by adding the bead or adding the third tab, an increase in current (and therefore brightness of the lamp) without the unwanted rooting, was effected. However, when both the bead and third tab were utilized, current of greater than 20 mA could be used without initiating the rooting problem. In the tests conducted, the lamp current was limited to 20 mA by the ballasts available.

Though not indicated on the chart of FIG. 5, severe sputtering was observed with the two tab electrode with bead. The three tab electrode with bead exhibited only limited sputtering.

Thus, there is provided a cold cathode subminiature fluorescent lamp which is not subject to premature failure caused by discharge rooting on lead wires, and consequent depletion and failure of the lead wire to glass envelope seal.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. A cold cathode subminiature fluorescent lamp comprising:

a glass envelope;

a pair of lead wires extending from outside said envelope, through said envelope at an entry location and into said envelope, said lead wires being sealed to said envelope at said entry location;

an electrode mounted on said lead wires in said envelope; and a ceramic-glass bead formed on and around said pair of lead wires in said envelope between said electrode and said entry location.

2. The lamp in accordance with claim 1 wherein said bead is substantially lead free.

3. The lamp in accordance with claim 1 wherein said bead is of a sintered lead free ceramic-glass material.

4. The lamp in accordance with claim 3 wherein said material includes barium oxide.

5. The lamp in accordance with claim 3 wherein said electrode comprises a plurality of tabs, each of said tabs comprising a metal wire forming a polygon, one side of each of said tabs being joined with a corresponding side of the other of said tabs to form an electrode base portion which is fixed to ends of said lead wires.

6. The lamp in accordance with claim 5 wherein said plurality of tabs comprises three tabs.

7. The lamp in accordance with claim 6 wherein said three tabs together present a surface area of about 132 $mm^2$.

8. The lamp in accordance with claim 5 wherein said metal wire is of a nickel-based metal.

9. The lamp in accordance with claim 8, further comprising a fill gas retained in said envelope.

10. The lamp in accordance with claim 9 wherein said fill gas is about 99.5% Neon and about 0.5% Argon, by weight.

11. The lamp in accordance with claim 9 wherein said fill gas is 90 Torr Penning mix.

12. The lamp in accordance with claim 3 wherein said lamp is of a diameter of no more than 7 mm.

13. The lamp in accordance with claim 12 wherein said electrode comprises a plurality of tabs, each of said tabs comprising a metal wire forming a polygon, each of said tabs being fixed to ends of said lead wires, each of said tabs having a surface area of about 44 $mm^2$.

14. The lamp in accordance with claim 13 wherein said plurality of tabs comprises three tabs.

15. The lamp in accordance with claim 14 wherein said metal wire is of a nickel-based metal, and said polygon is a rectangle, long sides of said rectangle being about 6.5 mm in length, short sides of said rectangle being about 3.4 4mm in length, and said wire being about 0.25 mm in diameter.

16. The lamp in accordance with claim 13, further comprising a fill gas retained by said envelope, said fill gas being 90 Torr Penning mix.

17. The lamp in accordance with claim 16 wherein said fill gas comprises about 99.5% Neon and about 0.5% Argon, by weight.

18. The lamp in accordance with claim 13, further comprising a fill gas retained by said envelope, said fill gas comprising about 99.5% Neon and about 0.5% Argon, by weight.

19. The lamp in accordance with claim 12, wherein said electrode presents a surface area of about 132 $mm^2$.

* * * * *